US007594693B2

(12) United States Patent
Ekornes et al.

(10) Patent No.: US 7,594,693 B2
(45) Date of Patent: Sep. 29, 2009

(54) TWO-STEP CONNECTING ELEMENT

(75) Inventors: Arve Ekornes, Ikornnes (NO); Jostein Bueide, Ikornnes (NO); Jan Kare Kroval, Ikornnes (NO)

(73) Assignee: Ekrones ASA, Ikornnes (NO)

( * ) Notice: Subject to any disclaimer, the term of this patent is extended or adjusted under 35 U.S.C. 154(b) by 0 days.

(21) Appl. No.: 11/894,965

(22) Filed: Aug. 22, 2007

(65) Prior Publication Data

US 2007/0290529 A1 Dec. 20, 2007

Related U.S. Application Data

(63) Continuation of application No. 10/482,932, filed on Jul. 2, 2004, now Pat. No. 7,322,641.

(30) Foreign Application Priority Data

Jul. 5, 2001 (NO) ..... 20013342

(51) Int. Cl.
*A47C 1/02* (2006.01)

(52) U.S. Cl. ..... 297/61

(58) Field of Classification Search ..... 297/61, 297/463.1, 463.2, 408, DIG. 2, 410; 248/407, 248/423, 181.1, 288.31, 409; 403/322.2, 403/DIG. 6

See application file for complete search history.

(56) References Cited

U.S. PATENT DOCUMENTS

| | | | | |
|---|---|---|---|---|
| 2,952,303 | A | | 9/1960 | Spound et al. |
| 2,989,341 | A | | 6/1961 | Schliephacke |
| 3,027,194 | A | | 3/1962 | Rumptz |
| 3,191,990 | A | | 6/1965 | Rugg et al. |
| 3,572,831 | A | | 3/1971 | Barecki et al. |
| 3,642,088 | A | * | 2/1972 | Smith ..... 180/331 |
| 3,712,666 | A | | 1/1973 | Stoll |
| 4,643,472 | A | * | 2/1987 | Schukei et al. ..... 294/94 |
| 4,693,516 | A | | 9/1987 | Knecht |
| 4,775,269 | A | * | 10/1988 | Brix ..... 408/239 R |
| 5,366,313 | A | * | 11/1994 | LaBarre ..... 403/108 |
| 5,816,658 | A | | 10/1998 | Wallis |
| 5,927,804 | A | | 7/1999 | Cuevas |
| 6,056,364 | A | * | 5/2000 | De Filippo ..... 297/410 |
| 6,217,117 | B1 | | 4/2001 | Weiland |
| 6,820,929 | B2 | | 11/2004 | Edrich et al. |

FOREIGN PATENT DOCUMENTS

| | | |
|---|---|---|
| WO | WO 92/06621 | 4/1992 |
| WO | WO 00/57754 | 10/2000 |

* cited by examiner

*Primary Examiner*—Milton Nelson, Jr.
(74) *Attorney, Agent, or Firm*—Seyfarth Shaw LLP

(57) ABSTRACT

The present invention concerns a device in a chair (1), especially a chair with an adjustable back of the chair (2) and head rest (3), in that in between a section of the head rest (3) and an attachment section on the chair construction is arranged a connecting element (18) with for example a rod (17), which by movement of the adjustable back of the chair (2) is arranged to affect the angle of the head rest (3) in relation to the back of the chair (2), and for the purpose of giving instructions on a head rest that by simple means be uncoupled in a reclined position of the back of the chair, there is according to the invention proposed a groove (21), a blocking device (22) and a coupling organ (24) which come into effect in the reclined position of the back of the chair, either in a manual or automatic way.

18 Claims, 6 Drawing Sheets

TWO-STEP CONNECTING ELEMENT

CROSS-REFERENCE TO RELATED APPLICATION

This is a continuation of U.S. application Ser. No. 10/482,932, filed Jul. 2, 2004, now U.S. Pat. No. 7,322,641 issued Jan. 29, 2008, and entitled "TWO-STEP CONNECTING ELEMENT."

BACKGROUND OF THE INVENTION

The present invention relates to a length-adjustable connecting element for a chair, with adjustable back of the chair and head rest, arranged between the head rest and the chair construction, which by movement of the adjustable back of the chair is arranged to affect the angle of the head rest in relation to the back of the chair, as the angle of the head rest may be altered by changing the effective length of the connecting element in the reclined position of the back of the chair.

PRIOR ART

From WO 92/06621, which is incorporated herein as reference, a device for a chair with adjustable back of the is chair and head rest is known, wherein the head rest may be adjusted in relation to the relative reclining positions of the back of the chair, using a telescopic length adjustable connecting element that stretches between the head rest and a suitable location on the chair. This device has relative complicated and expensive regulating organs and locking organs which must be operated through the upholstery of the chair, and they are difficult to make functioning in a satisfactory way.

PURPOSE OF THE INVENTION

The basis of the present invention lies in the object of presenting a connecting element that comprises simple parts, that is robust and dependable and that is silent in use.

An additional object of the present invention is to provide a connecting element with manual or automatic adjustment that may be adapted to any chair with a head rest, including such chairs having arched guides, and also such chairs with adjustable lower back support.

SHORT DESCRIPTION OF THE INVENTION

The aforementioned objects are achieved by a device of the introductory given kind, which according to the invention is characterised by the features evident from the enclosed patent claim 1.

Additional features and advantages of the present invention will be apparent from the following description taken in association with the enclosed drawings, and the additional enclosed patent claims.

SHORT DESCRIPTION OF THE DRAWINGS

DESCRIPTION OF EMBODIMENTS

Figure 1:
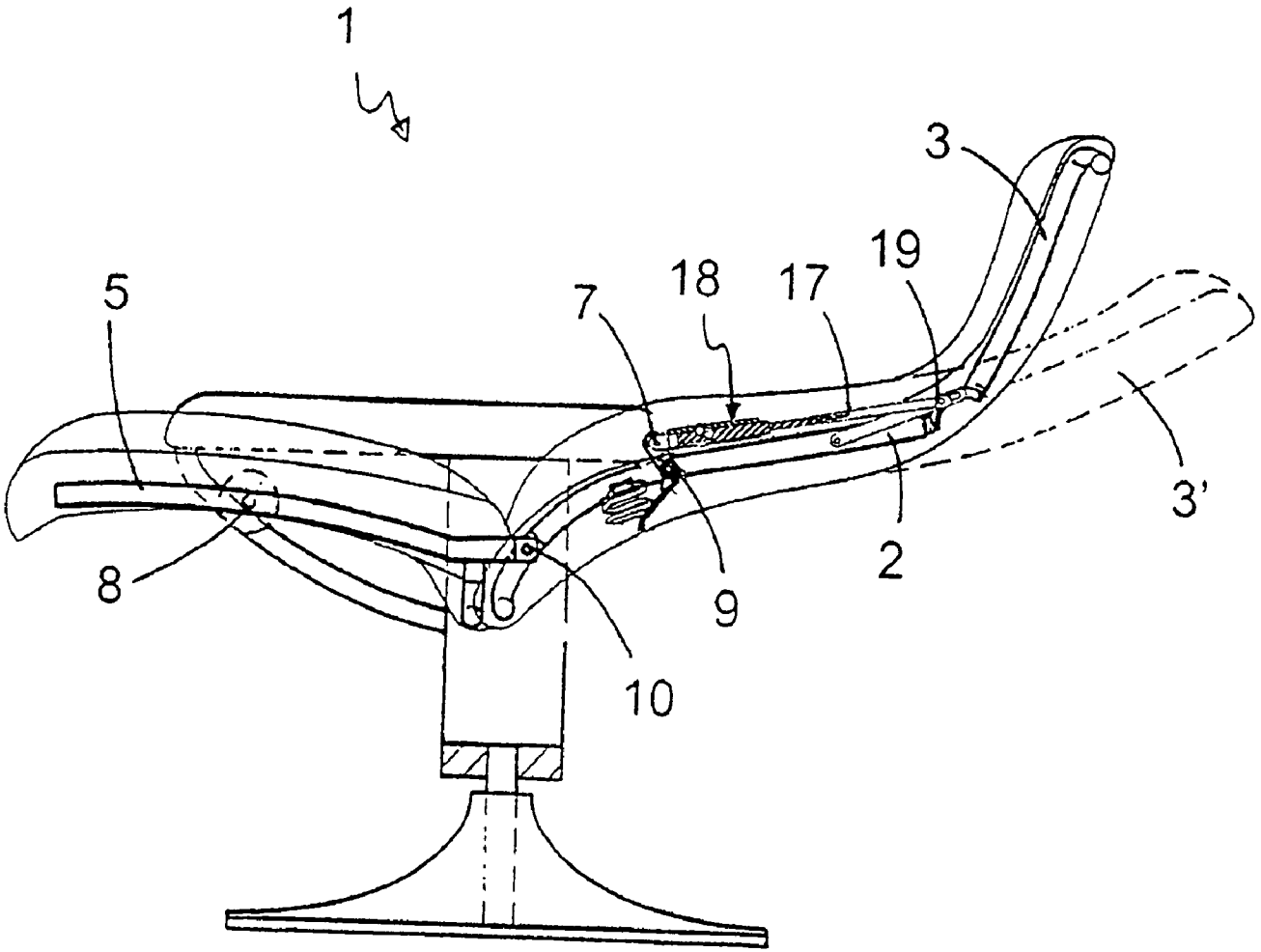
FIG. 1 is a phantom drawing of a chair according to the invention seen from the side, wherein the back of the chair is in a reclined position, simultaneously as the head rest is shown in a reclined position in dotted line.

On FIG. 1 the framework of a chair 1 of the type disclosed in WO 92/06621 is mainly shown, which chair 1 comprises an adjustable back of the chair 2 with an adjustable head rest 3.

It should be understood that the chair specified in FIG. 1 has a special adjustment of the head rest 3. The head rest is active in that it maintains an upright position when the back of the chair is reclined. In the reclined position of the back of the chair this function of the head rest may be disconnected by pulling the head rest somewhat forward. The head rest may then be reclined.

In FIG. 1 the back of the chair 2 is supported about an axis of rotation 9 making it possible for the back of the chair 2 to take different angular positions, as the back of the chair in the lower part at the same time has a connection joint 10 to the chair seat 5, which is accomplish by a known movement mechanism 8.

In FIG. 1 a connecting element 18 with a rod 17 is also shown, which is attached at the top to a joint 19 on the head rest, and which in the lower part is attached to a joint 7 on a permanent part of the framework of the chair, in a distance from the axis of rotation 9. The connecting element 18 with the rod 17 may take mainly two different length positions and has its shortest length amongst others when the back of the chair 2 is in an upright position, wherein the head rest 3 is almost an extension of the back of the chair 2, and forms its largest angle (almost 180°) with the back of the chair. When the back of the chair 2 is reclined to the position shown in FIG. 1, the relative movement of the back of the chair 2, and the connecting element 18 with the rod 17, will imply that the head rest 3 is pulled forward to a steeper angle in relation to the back of the chair 2. With the help of a mechanism, the connecting element may then be lengthened, so that the head rest may be reclined to the dotted position 3'.

In FIG. 2-5 one embodiment for a connecting element according to the present invention is shown.

In this embodiment the connecting element 18 comprises groove 21, blocking device 22 and coupling organ 24 which cooperate with each other so that the head rest 3 may be affected in the above mentioned ways by changing the length of the connecting element. The length of the connecting element 18 is further restricted in this embodiment by the stopping device 25 and track 26.

Figure 6:
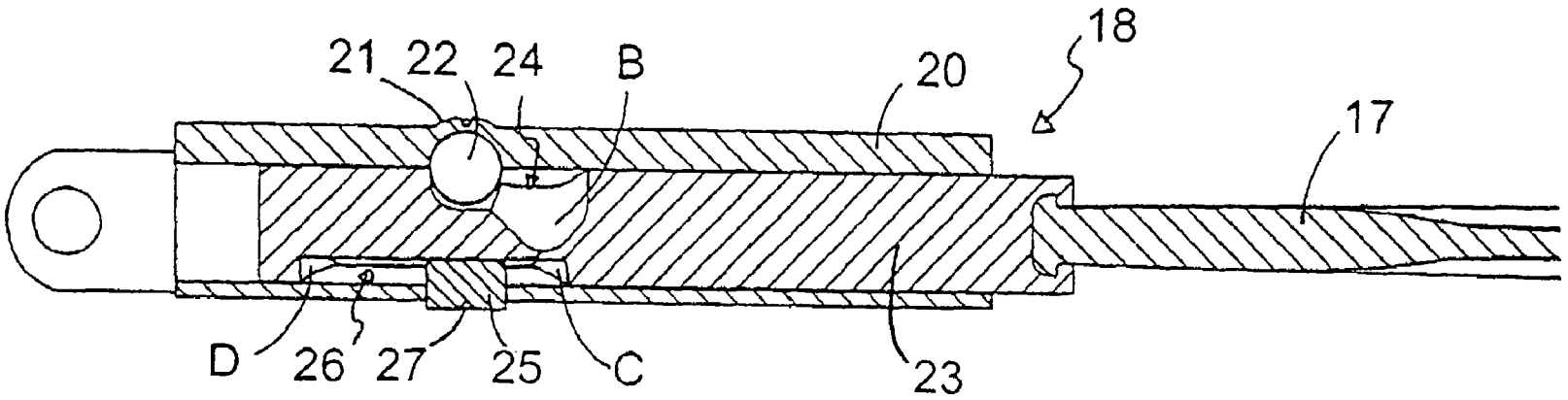
FIGS. 6 and 7 depicts the connecting element in FIG. 2-5 in a locked and an uncoupled position, respectively, in larger detail.
Figure 7:
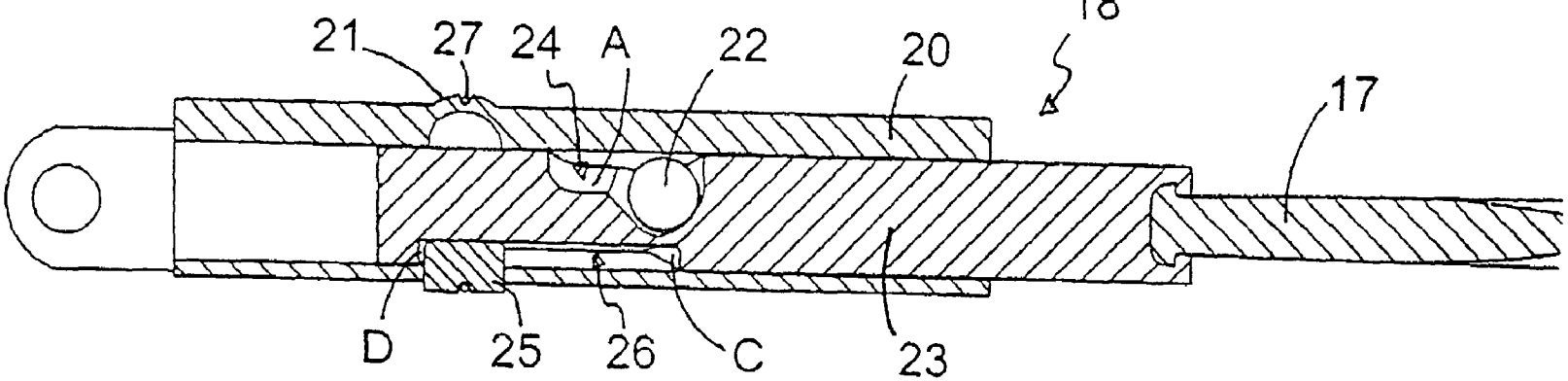

In FIGS. 6 and 7 it is shown in greater detail that the connecting element 18 comprises a guide 20 in the form of a circular cylinder, a blocking device 22 in the form of a sphere, a slider 23 and a stopping device 25. The coupling organ 24 is in the form of a first track in slider 23, wherein the coupling organ 24 has a more shallow part A and a deeper part B, which cooperate with the blocking device 22 and a groove 21 in guide 20.

Likewise, it may from FIGS. 6 and 7 be seen that the connecting element may comprise a track 26 in slider 23 with end restrictions C and D which cooperate with a stopping device 25 placed in a hole in guide 20. The stopping device 25 is held in place in guide 20 by a spring ring 27 surrounding the guide 20.

The main parts of the connecting element, such as the guide 20, the slider 23, and the rod 17 may be produced in a mouldable material such as a plastic material.

Figure 2:
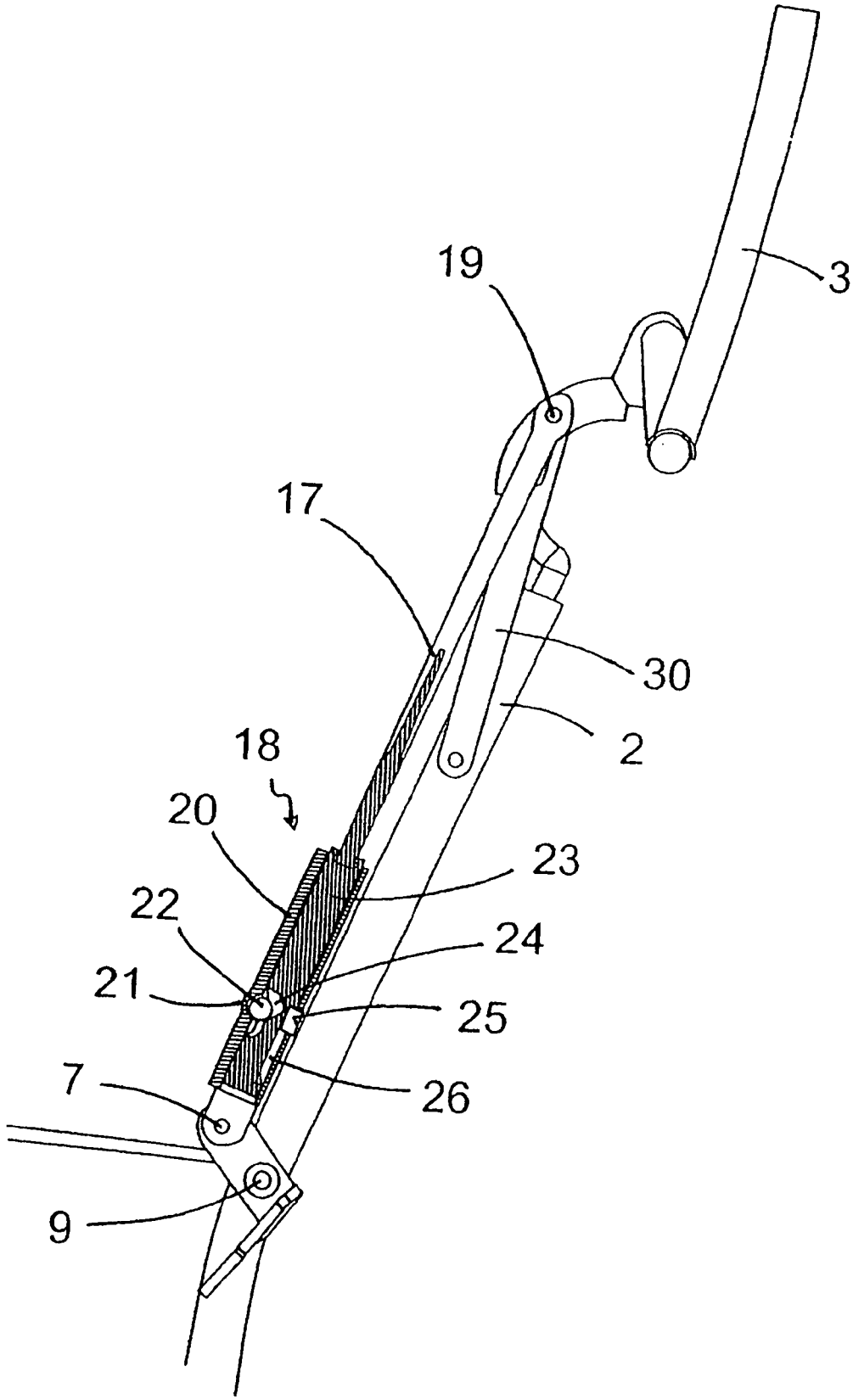
FIG. 2-5 depicts different positions of the head rest in relation to the back of the chair, in one embodiment of the connecting element according to the present invention, in a length profile.
Figure 3:
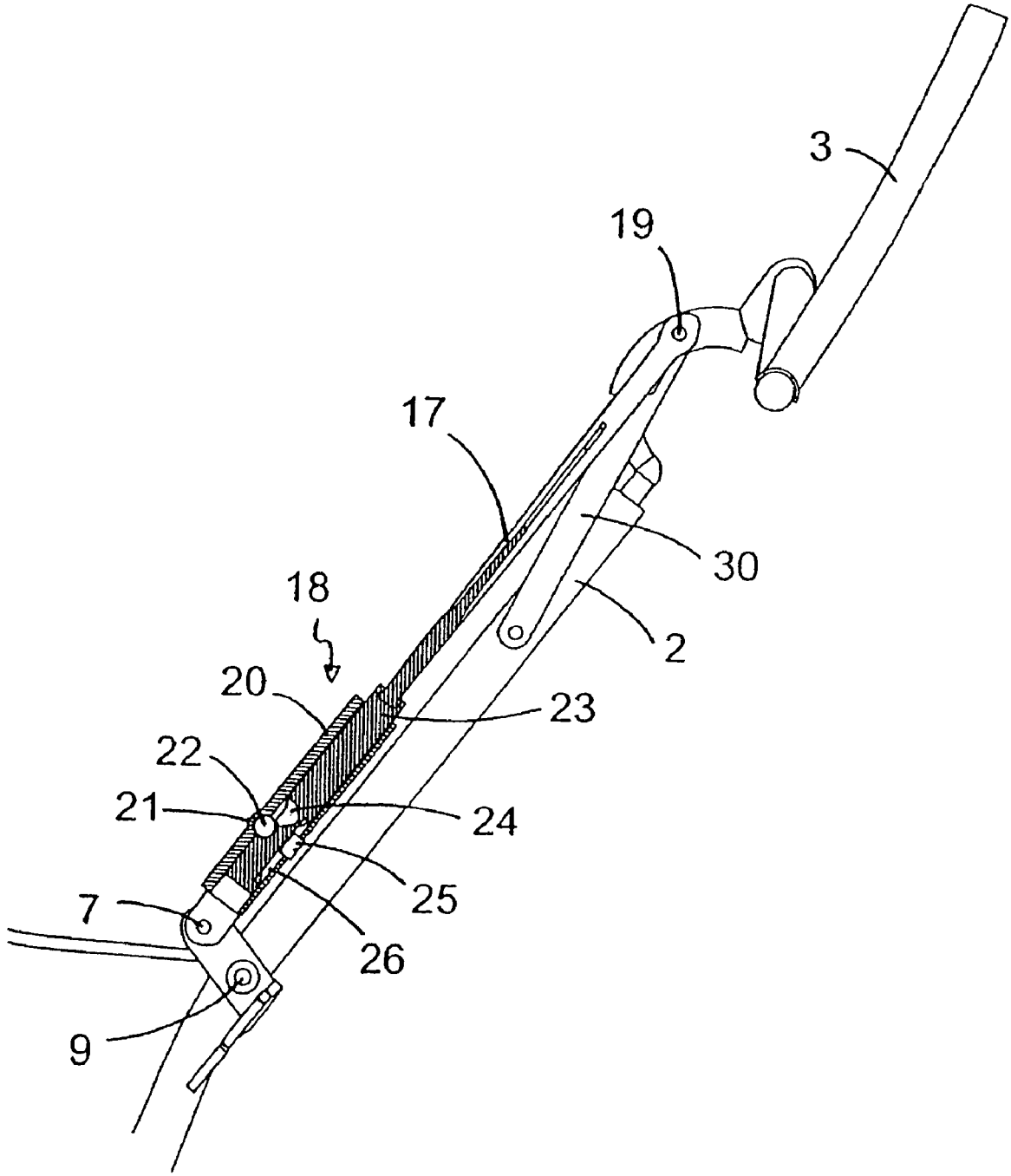
Figure 5:
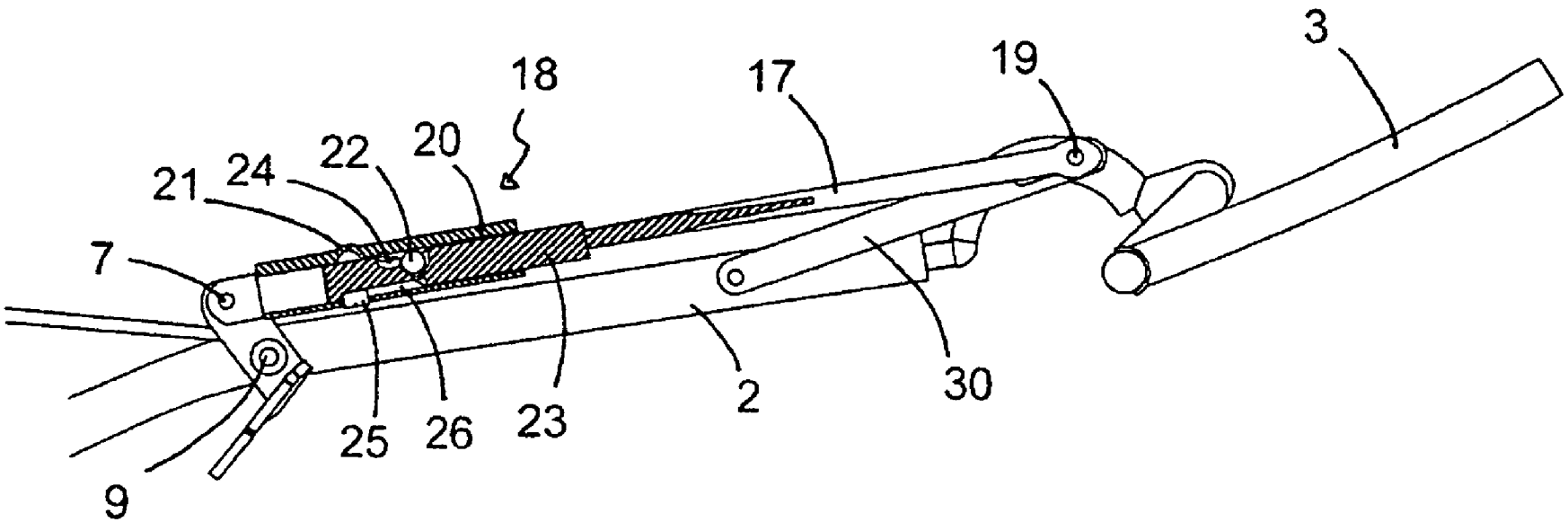

In an upright position of the back of the chair 2, the blocking device 22 will fall down between the shallow position A in the coupling organ 24 in the slider 23 and the groove 21 in the guide 20, due to gravity as is evident from FIG. 2. When the back of the chair 2 is reclined as shown in FIG. 3, the head rest function is locked. In the reclined position of the back of the chair 2 as shown in 4, a small (manual) pull forwards of the head rest 3 will release the blocking device 22 out of clamp between the shallow position A in the coupling organ 24 and the groove 21, down into the deeper position B of the coupling organ 24 due to gravity, and thereby uncouple the head rest as shown in FIG. 5. This implies that the slider 23 will move in the guide 20, and not fall down between position A in the coupling organ and the groove 21 until in a new upright position of the back of the chair 2. When the back of the chair 2 is reclined down again, the blocking device 22 will lock the slider 23 to the guide 20 and the head rest function is regained in cooperation with the connecting element 18.

The movement of the head rest 3 is further restricted in this embodiment by the movement of the slider 23 in guide 20 being restricted by the guiders stopping device 25, which run in the gliders track 26 between the end restrictions C and D. This restricts the movement of the head rest forward, in upright position, as the slider 23 may not be moved further into the guide 20 than when the stopping device 25 stands against the end restriction C in track 26, see FIG. 1 and FIG. 6. In the reclined position of head rest 3, the movement both forward and backwards is restricted, where the latter is of most current interest in that the slider 23 moves in the direction out of the guide 20 until the stopping device 25 stands against end restriction D in then track 26, see FIGS. 5 and 7.

Figure 4:
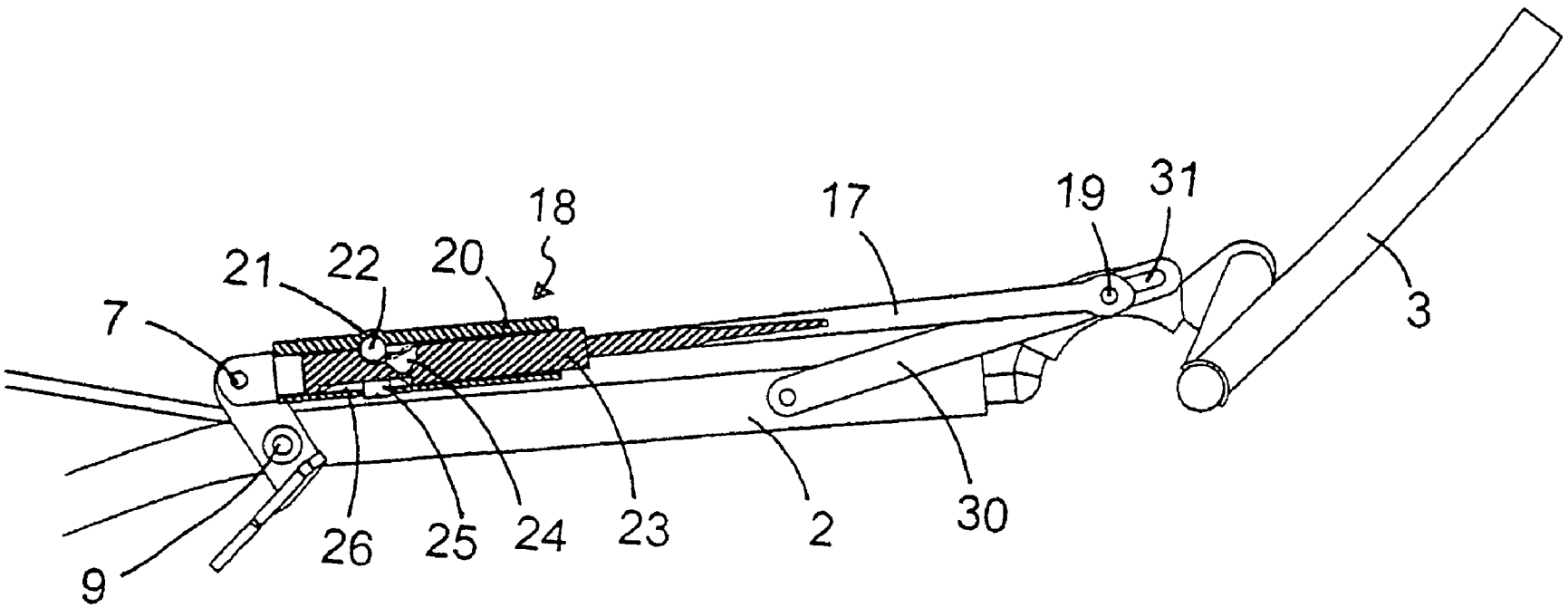

In the embodiment shown in FIG. 2-5 the chair is further equipped with a driver 30 attached to the back of the chair in its one end and to the joint 19 on the head rest in its other end by a track 31, as shown in FIG. 4. The driver 30 secures the head rest 3 against backward distortion in the reclined position, and brings the head rest 3 with it when the back of the chair 2 is raised up such that the slider 23 moves all the way down into the guide 20 in the upright position, making the blocking device 22 fall down between the groove 21 and position A in the coupling organ 24 again.

In other embodiments the stopping device with track as described over may be arranged on other places in the connecting element than shown in the figures, or on other movable parts between the back of the chair 2 and the head rest 3, such as for example on the arched guides of the head rest or as separate stopping devices similar to the driver 30, or the function may be attended by the upholstery.

The driver 30 may likewise be arranged on other places between the back of the chair 2 and the head rest 3, or its function may be attended by the upholstery for example, or devices in the arched guides of the head rest. Further, the driver 30 may be constructed in other ways such as a wire or a similar flexible organ with a certain length.

The connecting element may in its upper end be formed as a rod 17, which is fastened in the joint 19 on the head rest. The rod part may have a shape which gives a suitable elastic flexibility. Alternatively the rod may be somewhat arched or contain at least one slight angle. Further, the rod 17 may be attached to the slider 23 in a way that allows rotation and/or variation of the angle between them.

A person skilled in the art will understand that the embodiment over is only one example, and that the invention is restricted only by the claims enclosed. The guide 20 with slider may have another cross section than circular, such as for example oval or square. Likewise the blocking device 22 may be a roll or another element influenced by gravity. The coupling organ 24 and the groove 21 may have another suitable design adapted to the blocking device 22, such as a simple v-formed track which secures the above mentioned function of the groove 21, blocking device 22 and coupling organ 24.

Even if it is preferable both in technical production and in costs to produce most of the parts of the connecting element according to the invention from a mouldable plastic material, it will be understood that other materials such as metal or sintered materials may be used.

The invention claimed is:

1. A chair comprising a connecting element, comprising:

a guide, a slider, and a blocking device, wherein the guide is in the form of a cylinder provided with a groove, the slider having a first track with a shallow part and a deeper part, and the slider being adapted to move within the guide, and wherein the blocking device is in the form of a sphere arranged in the first track of the slider, the blocking device being alternatively positioned at one of either;

a locked position between the groove of the guide and the shallow part of the first track to lock the guide to the slider, and a free position between the guide and the deeper part of the first track of the slider allowing the slider to move freely within the guide, and a reclinable back of the chair, and a tiltable head rest, said head rest having a first angle, in relation to the back of the chair, wherein the connecting element is positioned between a section on the tiltable head rest and an attachment section on the chair, and is adjustable to affect said first angle, and wherein said first angle may be adjusted into a second angle by altering the length of the connecting element.

2. A chair according to claim 1, wherein the connecting element is attached at a first end to a joint on the head rest and at a second end to another joint on a permanent part of a framework of the chair.

3. The chair according to claim 1, wherein the connecting element further comprises a rod, said rod being partly made of a flexible material.

4. The chair according to claim 1, wherein the connecting element further comprises a rod, said rod being attached to the slider to form a rotatable angle.

5. The chair according to claim 1, wherein the connecting element has a cross section selected from a group of geometries consisting of circular, oval, square and multi-sided.

6. The chair according to claim 1, wherein the connecting element further comprises a rod, and said rod contains a slight angle.

7. The chair according to claim 1, wherein the connecting element further comprises a rod, and said rod is arched.

8. The chair according to claim 1, wherein the locked position of the blocking device of the connecting element in a shortened state is achieved only when the connecting element is in a substantially upright position.

9. The chair according to claim 1, wherein the locked position of the blocking device of the connecting element in a shortened state is unlocked when the connecting element is in a substantially reclined position.

10. The chair according to claim 1, wherein the blocking device moves into a position in said groove when the connecting element is in a shortened state and a substantially upright position.

11. The chair according to claim 1, wherein the blocking device remains in a locked position between said groove and said shallow part of the first track of the slider when the connecting element is extended from a shortened state in a substantially upright position.

12. The chair according to claim 1, wherein the blocking device moves into said deeper part of the first track of the slider when the connecting element is in a shortened state and a substantially reclined position.

13. The chair with the connecting element according to claim 1, wherein the slider may move freely within the guide when said blocking device is positioned in said deeper part of the first track of the slider and the connecting element is in a substantially reclined position.

14. The chair according to claim 1, wherein at least one of the guide and the slider of the connecting element are made of a moldable material.

15. The chair according to claim 14, wherein the moldable material is plastic.

16. The chair according to claim 1, wherein the guide includes a hole, the slider is provided with a second track having end restrictions thereon, a stopping device is in the hole in the guide and in the second track of the slider thereby limiting the movement of the slider in the guide.

17. The chair according to claim 16, wherein the stopping device comprises a stopper attached to the guide that runs in the second track of the slider, wherein e second track limits the movement of the slider in the guide.

18. The chair according to claim 17, wherein the locked position of the blocking device of the connecting element in a shortened state is unlocked by shortening the connecting element.

* * * * *

UNITED STATES PATENT AND TRADEMARK OFFICE

CERTIFICATE OF CORRECTION

PATENT NO. : 7,594,693 B2
APPLICATION NO. : 11/894965
DATED : September 29, 2009
INVENTOR(S) : Arve Ekornes, Jostein Bueide and Jan Kare Kroval It is certified that error appears in the above-identified patent and that said Letters Patent is hereby corrected as shown below:

Column 6 line 10 "e" should be "the".

Signed and Sealed this

Twenty-fourth Day of November, 2009

David J. Kappos

David J. Kappos
*Director of the United States Patent and Trademark Office*